United States Patent [19]

Corsetti

[11] 4,203,332

[45] May 20, 1980

[54] ADJUSTING TOOL FOR AIR DELIVERY REGISTER

[76] Inventor: Sheryll L. Corsetti, P.O. Box 473, Delray Beach, Fla. 33444

[21] Appl. No.: 937,144

[22] Filed: Aug. 28, 1978

[51] Int. Cl.[2] ..... B25B 9/00; A47F 13/06

[52] U.S. Cl. ..... 81/3 R; 294/19 R

[58] Field of Search ..... 81/3 R; 294/19 R, 22, 294/24

[56] References Cited

U.S. PATENT DOCUMENTS

| | | | |
|---|---|---|---|
| 703,178 | 6/1902 | Bye | 294/19 R |
| 1,579,726 | 4/1926 | Meyer | 294/19 R |
| 3,888,535 | 6/1975 | Rosso | 294/19 R |
| 3,936,088 | 2/1976 | Williams | 294/19 R |

*Primary Examiner*—James G. Smith

*Attorney, Agent, or Firm*—Malin & Haley

[57] ABSTRACT

A long-handled adjusting tool for adjusting the internal and external dampers in a register used in an air delivery system. The tool having pointed arm-like extensions for opening dampers that are closed. The tool also having a slot along the center line, thus allowing for adjusting the internal dampers. There are also slots along the sides of the tool for positioning the external dampers to control the amount of air flow.

4 Claims, 6 Drawing Figures

ADJUSTING TOOL FOR AIR DELIVERY REGISTER

BACKGROUND OF THE INVENTION

This application relates to a tool for adjusting the shutters disposed within the base of an air delivery register for the purpose of changing the throw or carry that an air stream travels on leaving a supply outlet. In the past, when a person desired to adjust the shutters of a register, he would usually stand on a chair and move the shutters with his hand, since the register is usually located high on a wall or in the ceiling. This practice has resulted in numerous accidents, due to people standing on chairs or other unstable pieces of furniture while adjusting the register.

SUMMARY OF THE INVENTION

The present invention provides an uncomplicated tool for adjusting both the inner and outer shutters of an air delivery register for the purpose of changing the throw that an air stream travels on leaving an air supply outlet. It is of simple construction which can readily be fabricated inexpensively in large quantities. The adjusting took provided by the present invention has a generally flat head and is provided with an extended shaft for adjusting distant registers without the use of a ladder or other stepping means. The generally flat head is provided with rearward curved upper portion, a longitudinal division running from the extreme outer end to a point along the center line of the head. The longitudinal division is used to adjust vertical interior shutters in a register. The ends of the upper portion terminate in edges which taper to a relatively sharp edge for insertion between adjacent shutters in an effort to open adjacent closed shutters.

The sides of the tool have a plurality of generally U-shaped cutouts to adjust shutters mounted on side walls of a room.

The primary object of the invention, therefore, is to provide a novel means for adjusting interior and exterior shutters in a register used in an air delivery system.

It is another object of the present invention to provide a means for insertion between adjacent closed shutters for opening the shutters.

It is a further object of the present invention to provide a simple means for adjusting both horizontal and vertical shutters with the same device.

It is still another object of the present invention to provide an adjusting tool for shutters in an air register located in a wall or ceiling that can be used while standing on the floor.

It is still a further object of the present invention to provide an adjusting tool for shutter in an air register that will not slip from the shutter when adjusting horizontal shutters.

Other objects and advantages of the invention will be apparent from the following description, the accompanying drawings and the appended claims.

DESCRIPTION OF THE PREFERRED EMBODIMENT

Figure 1:
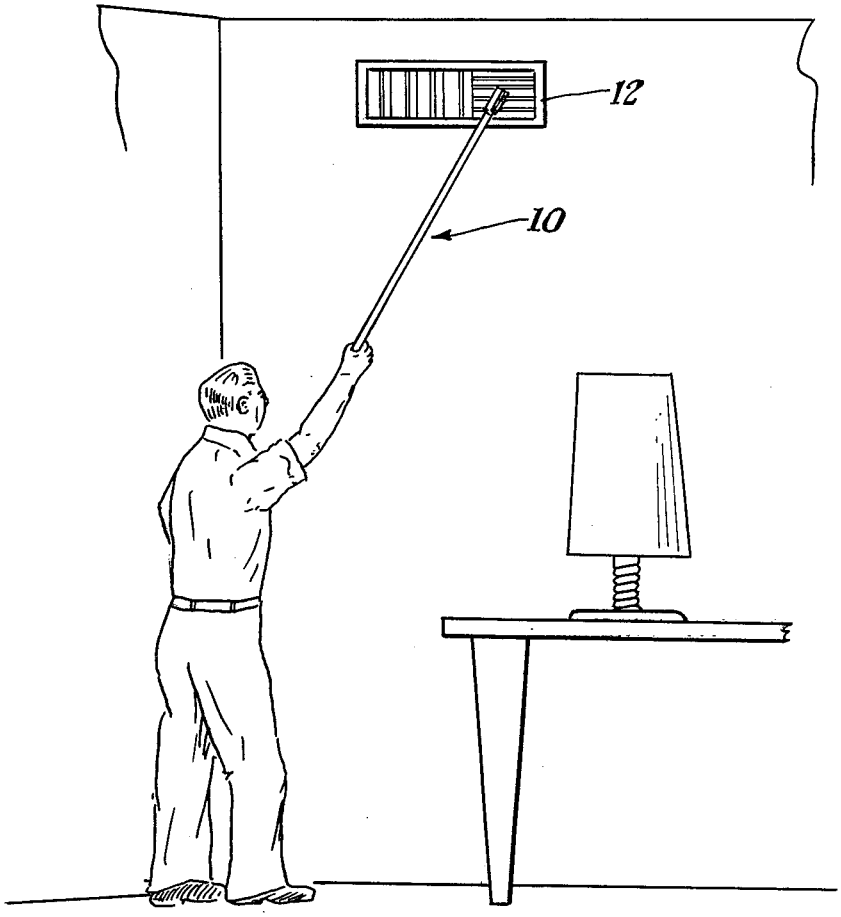
FIG. 1 is a perspective view showing the tool adjusting the shutters on a wall mounted air register.

Referring to FIG. 1, a wall mounted air delivery register 12 is shown being adjusted by an adjusting tool provided by the invention, indicated by the general reference number 10. For purposes of illustration, the adjusting tool 10 is shown in conjunction with a wall register, although the tool may be used to adjust ceiling mounted registers or even floor mounted registers.

Figure 2:
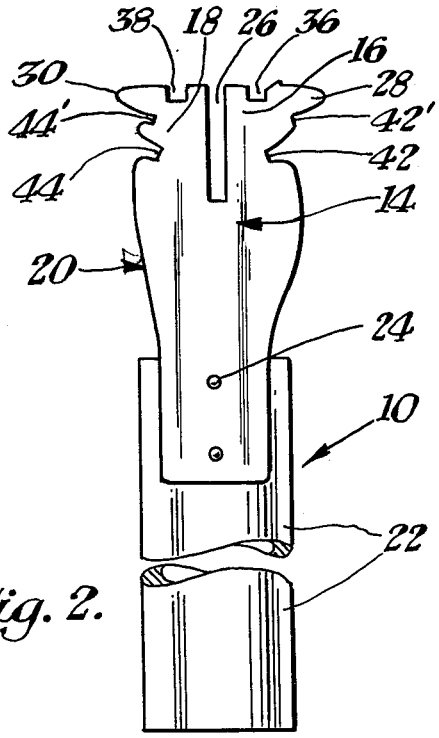
FIG. 2 is a front elevational view showing the tool secured to a pole.
Figure 3:
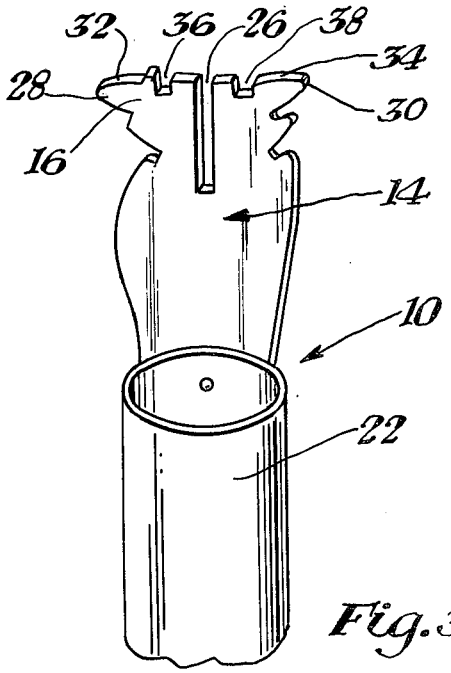
FIG. 3 is a perspective view of the top-rear of the tool.

Referring specifically to FIGS. 2 and 3, the adjusting tool is constructed of an integral fabricated gripping portion 14 having arms 16 and 18 joined by a body portion 20. The gripping portion 14 is preferably attached to a pole 22 by securing means 24 through the body portion 20.

The arms 16 and 18 preferably are symmetrical in configuration, and extend from the body portion 20, being separated by a longitudinal U-shaped aperature 26 as shown. The interior dimension of the aperature 26, from the top to the base 42 of the U-shape is sufficiently long to generally encompass a shutter. Each arm 16 and 18 has a generally pointed flat tip 28 and 30 which is tapered outwardly for initially opening fully closed shutters in an air register. The lateral edges 32 and 34 of the arms 16 and 18 are tapered blade-like for easy sliding between adjacent horizontal shutters for initial opening. Further, each arm 16 and 18 has smallish generally U-shaped cutouts 36 and 38 disposed along the lateral edges 32 and 34, which aid in controlling slippage when the shutters are being adjusted.

The side periphery of said gripping portion 14 has a plurality of angularly disposed cut-outs 42, 42', 44 and 44' which are sized to fit upon the shutter tips to adjust the position of said shutters.

The width dimension of the tool 10 narrows from the gripping portion 14 to the body 20, thus allowing the tool to engage the interior shutters of an air register through the exterior shutters.

Figure 4:
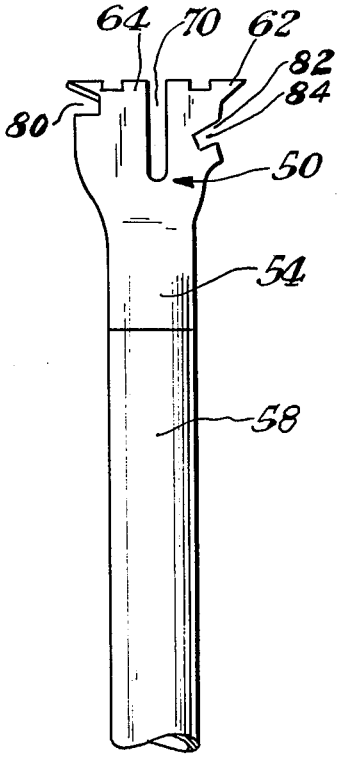
FIG. 4 is a front elevational view of another embodiment.
Figure 5:
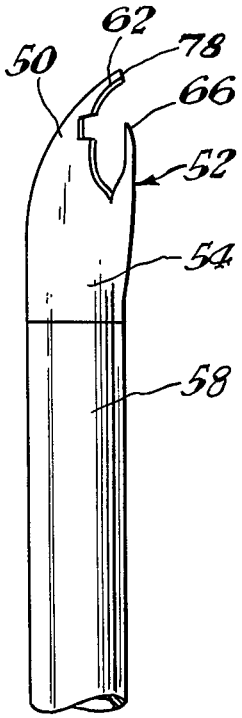
FIG. 5 is a side view of the right side as shown in FIG. 4.
Figure 6:
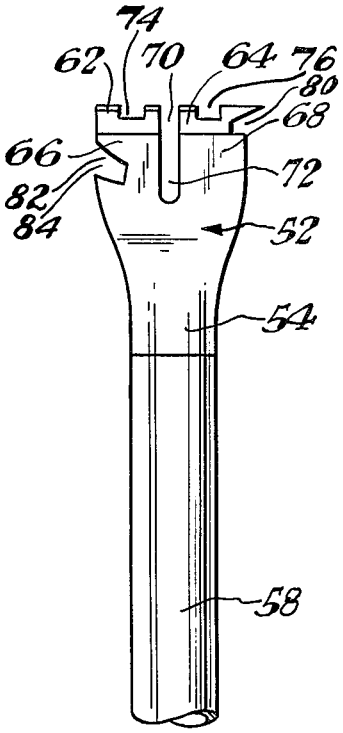
FIG. 6 is a rear elevational view of the embodiment of FIG. 4.

FIGS. 4, 5, and 6 show an alternative embodiment having two generally flat shaped gripping portions, a front portion 50 and a rear portion 52, and a cylindrical body 54, for securing both gripping portions to a handle 58. The gripping portions 50 and 52 are provided with a pair of rearward curved members 62 and 64, and 66 and 68 respectively. These members are generally pointed with knife-like edges to enable the adjusting tool to open shutters that are completely closed. One section includes members 62 and 66 and the other section includes members 64 and 68.

Both front 50 and rear 52 gripping portions are divided by a longitudinal U-shaped cutout 70 and 72, respectively. These cutouts are used in adjusting the interior shutters of a register. The adjustment of interior shutters is further aided by the front gripper 50 being longer than the rear gripper 52 as illustrated in FIG. 5.

The tool is so designed that the front gripper 50 is in spaced relationship with the rear gripper 52. This spaced relationship allows adjustment of exterior shutters to a desired position, while at the same time the interior shutters can be adjusted by the generally U-shaped cutouts 74 and 76 disposed along the top edge 78 of the front gripper 50. The U-shaped cutouts are of sufficient depth to engage the leading edge of a shutter. The spaced relationship accommodates angularly disposed cutouts 80, 82, and 84 along the longitudinal edge of the front gripping portion 50 and the rear gripping portion 52. These angular cutouts allow the control of the exterior shutters from a full open position to a near closed position.

While the form of the device described constitutes the preferred embodiment of this invention, it is to be understood that the invention is not limited to this precise form of device, and that changes may be made therein without departing from the scope of the invention.

What is claimed is:

1. A tool for adjusting external and internal dampers in a register used in an air delivery system, comprising:

a handle means to reach registers at a distance, and an adjusting means attached to an end of said handle means including a base for attaching said adjusting means to said handle means, and a body attached to said base and having a longitudinal slot separating said body into two sections allowing adjustment of said internal dampers, each said section having a distal transverse edge with a shallow indent to grip external dampers and prevent slippage, and an outward longitudinal edge having a plurality of angular indents to adjust said external dampers, said longitudinal edge and aid distal transverse edge forming outwardly extending arms for initial opening of said dampers.

2. A tool for adjusting external and internal dampers in a register used in an air delivery system, comprising:

a handle means to reach registers at a distance, an adjusting means attached to an end of said handle means including a base for attaching said adjusting means to said handle means a body attached to said base, said body having a front gripping portion and a rear gripping portion, said portions in generally flat parallel spaced relationship to adjust said external dampers, each said portion having a longitudinal slot separating each said portion into two members, said longitudinal slots being in parallel alignment with each other allowing adjustment of said internal dampers, each said member having a distal transverse edge with a shallow indent to grip external dampers and prevent slippage and an outward longitudinal edge having a plurality of angular indents to adjust said external dampers, said longitudinal edge and said distal transverse edge forming outwardly extending arms for initial opening of said dampers.

3. An adjusting tool as set forth in claim 2, wherein: said rear gripping portion is smaller in length than said front gripping portion and each said member of said rear gripping portion having a transverse edge, and an outward longitudinal edge having an angular incident to adjust external dampers, said longitudinal edge and said distal transverse edge forming an angular edge.

4. An adjusting tool as set forth in claim 3, wherein: said front gripping portion and said rear gripping portion are curved rearward at said distal transverse edge for adjusting said external dampers.

* * * * *